United States Patent [19]

Moehlenpah

[11] 3,978,783

[45] Sept. 7, 1976

[54] APPARATUS FOR FABRICATING WOOD STRUCTURES

[76] Inventor: Walter G. Moehlenpah, 906 Old Warson Road, Ladue, St. Louis County, Mo. 63124

[22] Filed: June 4, 1975

[21] Appl. No.: 583,650

[52] U.S. Cl. ..... 100/53; 100/100; 100/193; 100/218; 100/231; 100/DIG. 13; 144/288 C; 227/152; 269/321 F

[51] Int. Cl.[2] ..... B30B 15/16

[58] Field of Search ..... 227/152; 144/288 C; 269/321 F; 100/53, 218, 193, DIG. 13, 100, 231

[56] References Cited

UNITED STATES PATENTS

| | | | |
|---|---|---|---|
| 3,068,483 | 12/1962 | Moehlenpah et al. | 100/DIG. 13 |
| 3,255,943 | 6/1966 | Sanford | 100/DIG. 13 |
| 3,379,354 | 4/1968 | Moehlenpah et al. | 100/DIG. 13 |
| 3,388,657 | 6/1968 | Jureit | 100/DIG. 13 |
| 3,530,790 | 9/1970 | Post | 100/100 |
| 3,728,958 | 4/1973 | Moehlenpah et al. | 100/100 |
| 3,866,530 | 2/1975 | Moehlenpah | 100/53 |

*Primary Examiner*—Billy J. Wilhite
*Attorney, Agent, or Firm*—Koenig, Senniger, Powers and Leavitt

[57] ABSTRACT

Apparatus for fabricating wood trusses having upper chords, lower chords, and web members, and more particularly for fabricating flat floor trusses. The apparatus has an elongate frame carrying a first series of supports for supporting the upper chord members and a second series of supports for supporting the lower chord members. A press is movable laterally along each chord from support to support to drive nailing plates into the wood members from above and below. Each support has a base, a vertical plate extending up from the base, and arms cantilevered from the vertical plate. Each support is movable longitudinally along the frame so as to be selectively positioned along the frame to support the wood members at this intersection. These supports are selectively securable to the frame in their selected positions with the vertical plates of the first and second series of supports in back-to-back relation with one another. In each support, the included angle between the bottom surface of its base and the inner face of its vertical plate is slightly greater than 90° so that upon securing the bases of back-to-back supports to the frame, the vertical plates of these back-to-back supports are drawn together in face-to-face relation and preloaded so as to resist outward forces imposed on the cantilever arms of the supports during jigging and clamping of the wood members to the supports. A pneumatically operated clamp is also disclosed which holds the ends of the chords and an end web member in desired position, this clamp being movable to a retracted position to facilitate removal of the completed truss from the apparatus. An arrangement for biasing the press inwardly toward the supports as the press moves laterally is also disclosed so as to maintain press actuation switches carried by the press and switch actuators carried by the supports in desired operating position relative to one another.

15 Claims, 6 Drawing Figures

APPARATUS FOR FABRICATING WOOD STRUCTURES

BACKGROUND OF THE INVENTION

This invention relates to apparatus for fabricating wood structures, and is more particularly concerned with apparatus for fabricating shallow depth flat trusses for use as floor joists or the like.

More particularly, this invention is an improvement in apparatus for fabricating wood structures, such as disclosed in my U.S. Pat. No. 3,866,530. The apparatus disclosed in my above-mentioned patent effectively overcame many of the problems encountered in the fabrication of shallow depth flat floor trusses. More particularly, this apparatus enabled the fabrication of a wide variety of sizes and configurations of flat floor trusses at high production rates.

Specifically, this above-mentioned apparatus utilized an elongate frame which carried a plurality of supports movable longitudinally along the frame in back-to-back relation for supporting the wood members in position for being secured together by the nailing plates. However, upon forcibly biasing or jigging the wood members in abutting relationship with one another prior to being secured together by nailing plates, a substantial outward clamping load was exerted on the support members which tended to cause the support members on opposite sides of the frame to open up from their intended back-to-back relation. This opening up of the support members caused mislocation of the wood members and induced unwanted inaccuracies in the truss.

This prior apparatus utilized two presses, one for each side of the frame, each of which was mounted on a cart movable along the frame. Each cart had a control system for accurately stopping the cart at an operating position at each support and for initiating operation of the press to drive nailing plates into the wood members at each support. Movement of the press mounting cart was controlled by proximity switches carried by the press cart actuable by means, such as a magnet, mounted on the frame at each desired operating position. However, as the cart moved laterally along the frame, the press tended to move in and out relative to the frame. Under certain circumstances the proximity switches were not tripped at the desired time thus preventing operation of the press at an intended location.

The above-described prior art apparatus also utilized an automatic ejector system for removal of completed trusses from the apparatus. It was found, however, in some cases that after fabrication the ends of the truss would sometimes become wedged between various wood member clamps thus making ejection of a completed truss difficult. More particularly, it was found that if the truss ejectors at the center of the truss were actuated prior to the ejectors at the ends of the truss, the center of the truss would be bent up thus causing the length of the truss to increase.

SUMMARY OF THE INVENTION

Among the several objects of this invention may be noted the provision of apparatus for fabricating shallow depth, flat floor trusses which is adjustable to accommodate trusses of various depths, lengths and configurations; the provision of such apparatus which accurately holds the wood members in desired positions prior to being secured together by nailing plates when subjected to high clamping and jigging forces; the provision of such apparatus which enables the press to travel generally laterally from operating position to operating position along the apparatus at a relatively high rate of speed and to reliably stop at each operating position for driving nailing plates into the wood members at each operating position; the provision of such apparatus which insures that the ends of the fabricated truss are free to be ejected from the apparatus without binding or restraint on the truss; and the provision of such apparatus which is of rugged construction and relatively low cost. Other objects and features of this invention will be in part apparent and in part pointed out hereinafter.

Briefly, apparatus of this invention is intended to fabricate wood structures, such as trusses of the type having lower chord members, upper chord members, and web members extending from the lower chord members to the upper chord members. The apparatus comprises a press having an upper and a lower platen which are relatively movable toward and away from one another for driving nailing plates into two or more of the wood members of the truss from above and below, and means for supporting the wood members which are to be joined together by the nailing plates. This supporting means includes a plurality of supports and means cantilevered relative to each support for holding wood members with clearance therebelow for the press. The apparatus further includes means mounting the press for movement thereof along a chord into an operating position at a first support for driving nailing plates into the wood members, and for movement in a generally lateral direction with respect to the press sideways out of its operating position at the next successive support along the chord. The supporting means further comprises a frame having an upwardly facing horizontal surface carrying a series of supports for holding the upper chord members and a second series of supports for holding the lower chord members, the first and second series of supports having cantilever means secured thereto. The supports for the upper chord members and the supports for the lower chord members are arranged in close back-to-back relation substantially at the vertical longitudinal center plane of the frame and are movable relative to one another longitudinally of the frame. Each support has a generally horizontal base and a generally vertical member extending up from the inner edge of the base adjacent the vertical longitudinal center plane of the frame. The base has a bottom surface for engagement with the upwardly facing horizontal surface of the frame and the member of each support has an inner generally vertical face adapted to engage a corresponding face of another support in back-to-back relation therewith. The included angle between the bottom surface and the inner face of a support is specified to range between about 91° and 95°. The apparatus further includes means for releasably securing each support to the horizontal surface of the frame which when unsecured permits the support to be moved longitudinally along the frame to any selected position therealong, and which when secured fixedly secures the support to the horizontal surface of the frame, whereby with two of the supports at least partially in back-to-work relation on the frame and with these two supports being fixedly secured to the horizontal surface of the frame with their bottom surfaces flush with the horizontal frame surface, their vertical member inner faces are drawn together in face-to-face engagement substantially on the longitudinal center plane of the frame.

In another embodiment of apparatus of this invention, generally similar to that described above, means is provided movable between an operating position for holding at least one end of the upper and lower chord members of the truss in desired spaced relation and for holding an end web member in selected endwise position relative to the ends of the chord members during fabrication of the truss and a retracted position to facilitate lifting of the truss generally vertically for removal of the truss from the apparatus.

In still another embodiment of the apparatus of this invention, means is provided for controlling movement of the press mounting means including actuating means at each station and switch means carried along with the press, the switch means being actuable by the actuating means as the press moves into its operating position at a station for stopping movement of the press mounting means with the press in its operating position at the station. The press is movable relative to the press mounting means toward and away from the frame and carries the switch means with it for actuation by the actuating means. The apparatus further comprises means for maintaining the switch means carried by the press and the actuating means carried by the frame in predetermined in-and-out relation relative to one another as the press moves laterally along the frame to insure actuation of the switch means as the press moves laterally from one station to the next. The maintenance means comprises means for biasing the press inwardly toward the frame, guide means carried by the frame, and means carried by the press and movable therewith and engageable with the guide means for limiting inward movement of the press toward the frame.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
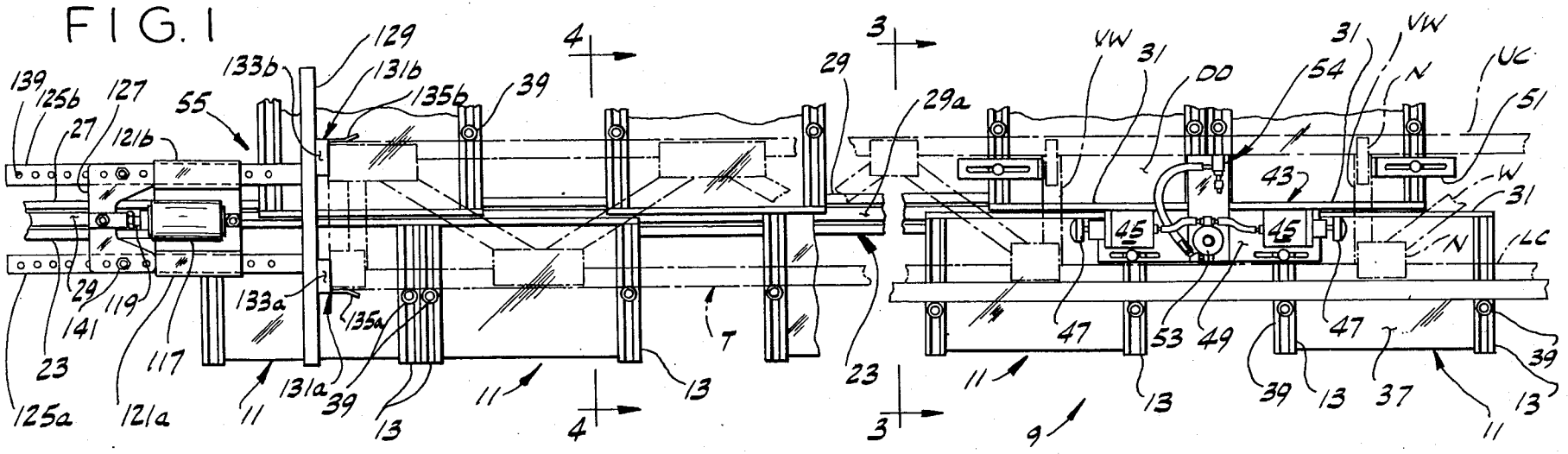
FIG. 1 is a plan view of wood structure fabricating apparatus of this invention showing an end lumber clamp in its operating position in which it holds the chords and outer end web member in predetermined positions for being secured together by nailing plates.

Referring now to the drawings, apparatus of this invention, indicated in its entirety at 1, is shown in FIG. 1 for fabricating wood trusses T of the type having lower chord members LC, upper chord members UC and web members W extending from the lower chord members to the upper chord members. More particularly, apparatus of this invention is especially useful for fabricating flat, shallow-depth trusses made of 2 × 4 commercially available lumber for use as floor joists. The trusses shown in the drawings have optional duct openings DO formed at the midpoint of the truss to permit ventilating ducts to be routed between the upper and lower chords. Duct openings DO are defined by a pair of spaced-apart vertical inner web members VW, one on each side of the midpoint of the truss, and by the upper and lower chords. It will be understood, however, that apparatus of this invention may also be utilized to fabricate trusses of other configurations without the above-said duct openings.

Figure 2:
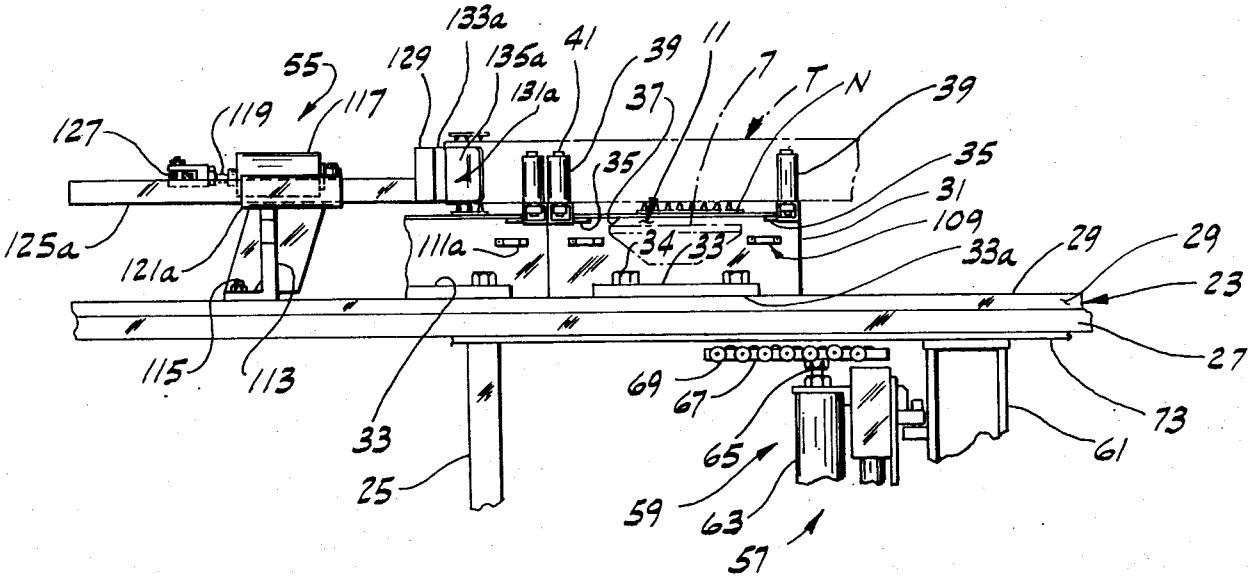
FIG. 2 is a side elevational view of FIG. 1.
Figure 4:
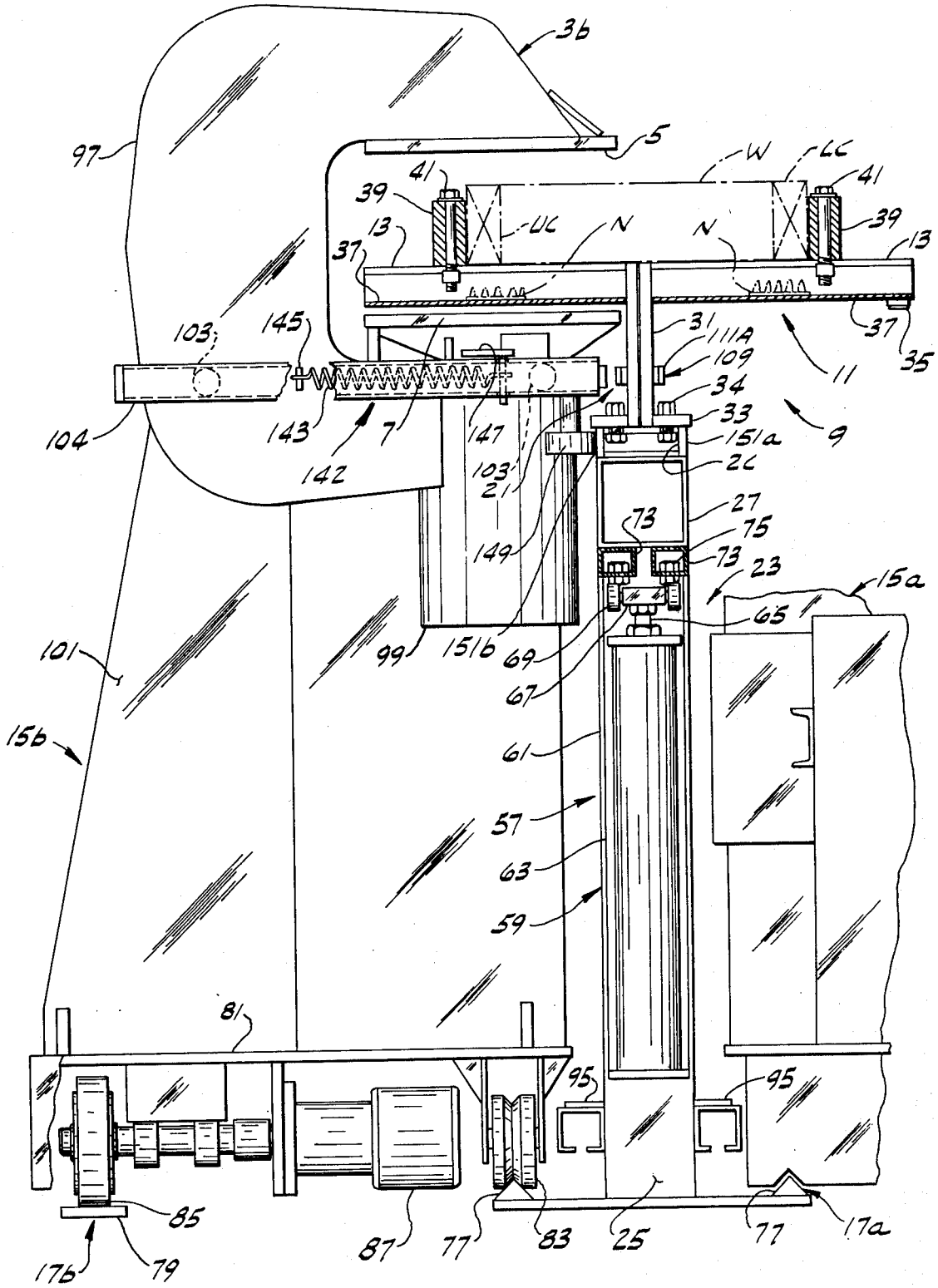
FIG. 4 is a vertical cross section taken on line 4—4 of FIG. 1 illustrating press carts movable on tracks lengthwise along the frame.

Apparatus 1 comprises a pair of presses, as indicated at 3*a*, 3*b*, each having an upper platen 5 and a lower platen 7 (see FIG. 4) which are relatively movable toward and away from one another for driving nailing plates N into two or more of the wood members from above and below thereby to rigidly secure the wood members together at the joints of the truss. The apparatus further includes means, as indicated generally at 9, including a plurality of lumber platforms or supports 11 and arms 13 cantilevered from each support for holding the wood members in position so that they may properly be joined together by nailing plates N, the support and the cantilever arms together constituting cantilever means. In FIGS. 2 and 4, it can be seen that the cantilevered arms 13 support the wood members with clearance for the press below the arms. Each of the presses is mounted on a respective press carriage or cart 15a, 15b movable lengthwise of apparatus 1 along respective tracks 17*a*, 17*b* adjacent the lower and upper chords, respectively, of the truss for driving nailing plates at each joint along the respective chord of the truss. Each press, as it is carried by its carriage, moves along its track in a generally lateral direction with respect to the press into an operating position (see FIG. 2) at a first support 11 for driving nailing plates into the wood members, and after driving the nailing plates moves generally sideways out of its operating position at the first support and into its operating position at a next successive support along its respective chord. Each press 3a, 3b and its respective press cart or carriage 15*a*, 15*b* are movable along their respective tracks independently of one another to automatically drive nailing plates at each support along their respective chord. Movement of the presses is controlled by means, generally indicated at 19. Briefly, this controlling means includes means 21 (see FIGS. 4 and 5) movable with each carriage and press for sensing the approach of the press to its operating position at a support from one direction or the other along the chord of the truss in advance of its arrival at its operating station to initiate deceleration of the carriage and for sensing the arrival of the press at its operating position at a support so as to stop movement of the press at its operating position and to initiate operation of the press for driving nailing plates into the wood members. After driving nailing plates into the wood members at the first support, the press is automatically moved sidewise out of the first support to its operating position at the next successive support along its respective chord. This is repeated until all the nailing plates have been driven into the wood members along this respective chord.

More particularly, holding means 9 includes a frame 23 (constituting a central support means) carrying a series of supports 11 (constituting a series of support means) for holding upper and lower chord members and web members in position for being secured together by nailing plates N to form a truss. As shown in FIG. 2, frame 23 includes a series of posts 25 arranged in a row secured to and extending up from the floor and a horizontal member 27 carried by the upper ends of the posts and extending the length of the frame.

The series of posts 25 and the horizontal member 27 are generally coplanar and they permit the press carriages 15*a*, 15*b* to pass in close proximity to the vertical longitudinal center plane of the frame as the press carriages move along the chords of the truss being formed and thus permit shallow-depth trusses to be fabricated. A pair of built-up clamping channels 29 is secured, as by welding, to the upper face of horizontal member 27 and extends longitudinally thereof for slidably receiving portions of two series or rows of supports 11, one on each side of the vertical longitudinal center plane of frame 23, for a respective chord of the truss to be fabricated. The supports are movable independently of one another along the length of the frame for being positioned at the joints of a truss to be formed. Also, with this arrangement, the supports are positioned in close back-to-back spaced relation with the cantilever arms 13 extending laterally outwardly of the frame 23. Thus, the supports may be arranged to fabricate trusses of relatively shallow depth.

Figure 3:
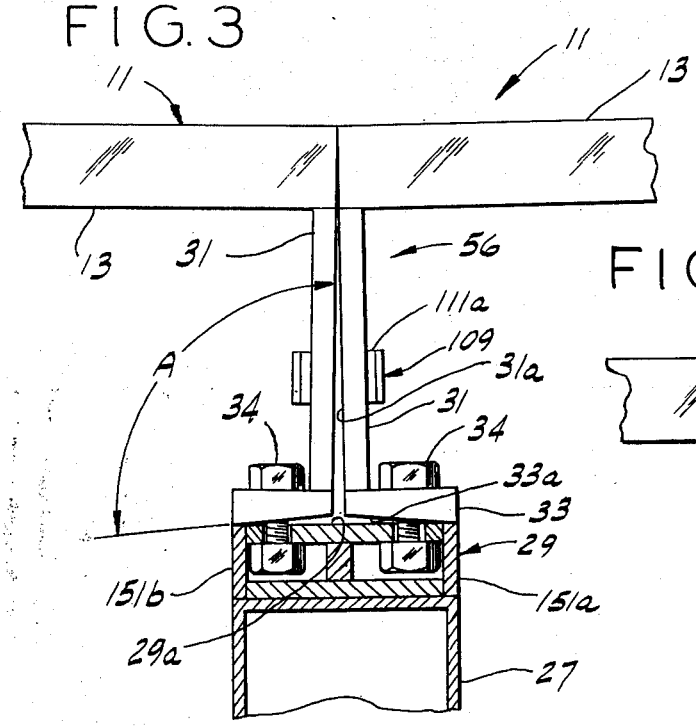
FIG. 3 is an enlarged vertical cross section taken on line 3—3 of FIG. 1 illustrating a pair of supports unsecured from the frame and movable lengthwise therealong, the included angle between the base and the vertical member of these supports being exaggerated for purposes of clarity.
Figure 3A:
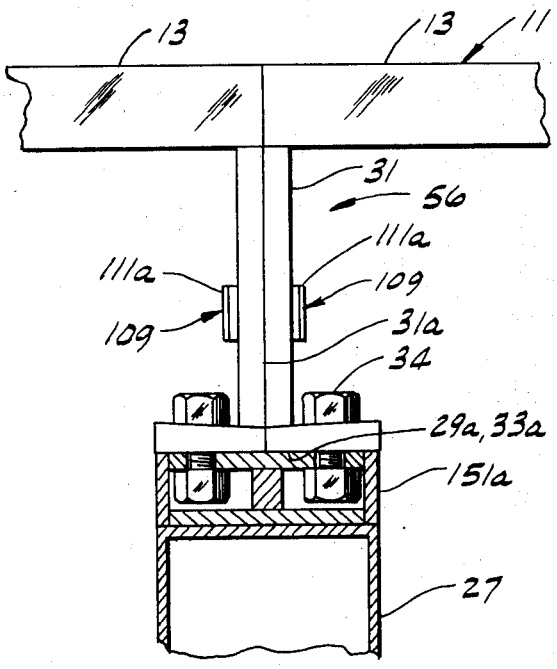
FIG. 3A is a view similar to FIG. 3 with the supports fixedly secured to the frame and with the supports in back-to-back relation.

In FIGS. 3, 3A, and 4, each support 11 is shown to compirse a generally vertical back plate 31 having an outwardly facing flange or base 33 at its lower end engageable with an upwardly facing horizontal surface 29*a* of clamping channels 29. Each base 33 carries means (e.g., bolts), as indicated at 34, for releasably clamping the support to surface 29*a* at any selected position therealong. With clamping bolts 34 unsecured, the supports are movable longitudinally along 29*a* of clamping channels 29 to any horizontal position. With the clamping bolts secured to the clamping channels, the support is fixedly secured to surface 29*a*. Arms 13 are cantilevered from the upper margin of the plate in side-by-side spaced relation (see FIG. 2) for supporting wood members on the top surfaces of the arms in position for being secured together by nailing plates N at a location between the arms. As is best shown in FIG. 4, each support is adapted for lateral entry of the lower platen 7 of a respective press 3*a*, 3*b* from one side or the other of the support below the cantilevered arms 13 to its operating position between the arms with the planes of the tops of the arms coplanar and with these planes spaced from the top surface of the lower platen 7 a distance sufficient to accommodate a nailing plate arranged with its teeth pointing upwardly for being driven into the wood members from below (see FIG. 4). The cantilever arms 13 are laterally spaced from one another a distance greater than the width of the lower platen of the press for entry of the lower platen of the press between the arms when the lower platen is moved upwardly to drive a nailing plate N upwardly into the wood members supported on the arms. Each cantilever arm 13 has a pair of inwardly projecting lugs 35 (see FIG. 2) secured thereto adjacent its lower edges for supporting a holder plate 37. These lugs support the holder plate 37 in a manner which permits it to be freely moved upwardly by the lower platen 7 of the press as the lower platen moves upwardly to drive a nailing plate N resting on the holder plate into the wood members from below. With the holder plate resting on the lugs, it is spaced from the wood members a distance sufficient to accommodate a nailing plate N.

The operating position of a press 3*a*, 3*b* at one of the supports 11 is more particularly defined as that position in which the press and its platens are substantially centered with respect to the cantilever arms 13 and the platens are positioned vertically relative to the wood members and fore and aft relative to plate 31 of the support so as to be above and below the joint in the wood members with the lower platen 13 below holder plate 37 when the latter is in its lowered position supported by lugs 35 and with the upper platen 5 above the joint in the wood members. Thus, with the press in its operating position, the press may be operated to drive nailing plates into the wood members without damage to the supports. The operating position of the press is most clearly illustrated in FIG. 2.

A stop 39 engageable with the outer face of a respective chord member UC or LC is slidably received by each cantilever arm 13, each stop being movable to any position along the length of its respective arm and being releasably secured to its arm by means of a clamping bolt 41. Stops 39 are positioned on the arms in predetermined positions relative to the center plane of frame 23, with the stops for the lower chord member being spaced from the stops for the upper chord members a distance corresponding to the depth of the truss thereby to prevent outward movement of the chord members during fabrication of the truss. It will be understood that the stops 39 may be positioned to slightly bow the upper and lower chords so that the fabricated truss has a slight bow to compensate for any sag due to the weight of the truss when the truss is placed in the building.

Power operated means, indicated at 43 in FIG. 1, is provided for biasing the web members into abutting relation with the upper chord members UC and the lower chord members LC and for holding the various web members W in position on supports 11 for being secured together by nailing plates N. Power operated means 43 comprises a pair of opposed air cylinder units 45 each having a ram 47 movable outwardly toward the ends of the truss. These air cylinder units are secured to a mounting plate 49 which is adapted to be releasably secured to arms 13 of one or more supports 11 so that the air cylinder units are substantially centered with the duct opening DO of the truss to be formed. Each ram 47 is engageable with the inner face of an adjacent vertical web VW, preferably adjacent the end thereof in contact with the end of an adjacent angled web W. An adjustable stop 51 is carried by an arm 13 of an adjacent support 11 so as to hold the vertical webs VW in position upon actuation of the air cylinder units 45. To initiate clamping of the wood members, a manually operated push-type valve 53 is provided between the air cylinders. Air is supplied to valve 53 by means of an air distribution system 54 included with frame 23 at the center portion thereof. This air distribution system permits the position of the supports 11 readily to be adjusted along clamping channels 29. Upon operation of the valve 53, rams 47 extend to engage the inner faces of their respective vertical webs VW. As each vertical web engages stop 51, continued actuation of the ram causes the other end of the vertical web to push against the adjacent angled web, thus forcing or biasing this web into engagement with the inner faces of both the upper and lower chords, and forcing or biasing the chords into firm engagement with stops 39, and further forcing the other web members into contact with the inner faces of the chords all along the truss. This clamping or biasing force is maintained until all the joints of the truss have been secured by nailing plates N. Each of the air cylinder units 45 is a spring return cylinder for automatically retracting its ram upon venting of air pressure from the cylinders. It will be understood that the arrangement of clamping air cylinders 45 may be adapted for use with trusses having angled innermost web members rather than vertical webs VW. It will be further understood that the power-operated means 43 may also be constituted by a toggle or scissors linkage actuated by an air cylinder to apply clamping forces to the vertical webs so as to force them endwise of the truss.

As is shown in FIGS. 1 and 2 and in accordance with this invention, a power-operated (i.e., pneumatic) end stop 55 is adjustably movable and releasably secured to clamping channels 29 at each end of the truss being formed for preventing endwise movement of the outermost web member relative to the chord members beyond a desired position and to prevent the ends of the chord members from moving apart beyond a selected distance or spacing. A detailed description of end stops 55 will be provided hereinafter.

In accordance with this invention and as best shown in FIG. 3, means, as generally indicated at 56, is provided for resisting the outward forces imposed on the cantilevered arms 13 upon actuation of the power-operated means 43 to clamp or jig the wood members in place and to bias the web members W into engagement with one another and with the chords UC and LC. As previously mentioned, the back plate 31 of each support 11 has an inner, generally vertical face 31*a* and the base of each support 33 has a bottom surface 33*a*. More specifically, the bottom 33*a* of the base is machined at an angle such that the included angle A (see FIG. 3) between the bottom surface 33*a* and the inner face 31*a* of each support is somewhat greater than 90°. It will be understood, however, that this angle may be formed in any manner, such as by welding the base and vertical plate at an angle. This included angle may range between about 90.5° and 95° and it preferably may range between about 91° and 92°. However, it will be understood that angles of less than 91° may be sufficient for resisting these outward forces. With the support 11 unclamped from upwardly facing horizontal surface 29*a* of clamping channels 29, the supports are movable longitudinally along the clamping channel to a selected position in which they support wood members W for having nailing plates N driven therein from above and below. With the supports positioned in their selected locations along the clamping channel, clamping bolts 34 may be tightened to fixedly secure each of the supports to the clamping channels. Prior to tightening of the clamping bolts, it will be noted supports 11 in back-to-back relation with one another are in contact with one another at the upper ends of their back plates 31 and that only the outer or toe portion of the bottom surface 33*a* of base 33 contacts surface 29*a* of the clamping channels. Upon tightening of the clamping bolts, the heel portions of bottom surfaces 33*a* of the bases adjacent the vertical center plane of the frame are drawn downwardly to be flush with horizontal surface 29*a* and the inner faces 31*a* of the back plates are drawn together in face-to-face relation substantially on the longitudinal vertical center plane of frame 23 (see FIGS. 3*a*). As the vertical back plates are drawn together, they are elastically deformed so that they tend to spring back to their original position away from their respective bases 33. Thus, as the back plates of supports 11 in back-to-back relation with one another are both elastically deformed equal amounts, they each exert equal loads on one another which tend to cancel out. It will be noted that these loads exerted on one another are in opposite directions from the outward forces applied to their respective cantilever arms 13 by power-operated means 43. Upon actuation of the power-operated means, the outward forces exerted on cantilever arms 13 are counteracted by the preload of the back plates when they are drawn into vertical face-to-face relation with one another. Thus, it can be seen that by securing back-to-back supports 11 to clamping channel 29 in the above-described manner, the supports effectively resist substantial outward clamping forces which may be imposed on the supports and which may cause the back plates to separate.

As is shown in FIG. 4, means, as indicated at 57, is provided for lifting or ejecting a completed truss T clear of supports 11 and stops 39 so as to facilitate removal of the completed truss from the apparatus. More particularly, lifting means 57 comprises a plurality of lifting or ejector units, each indicated at 59 and each including a mounting bracket 61 releasably secured to frame 23, a lift cylinder unit 63 pivotally carried by the bracket for swinging between a stowed position (see FIG. 4) in which the lift clyinder is in line with posts 25 (i.e., substantially within the longitudinal center plane of holding means 9) so that press carriages 15*a*, 15*b* may move past the lift units and a lifting position in which the lift cylinder is swung out from the line of posts 25 and in which its piston rod 65 is movable from a lowered retracted position to a raised lifting position so that an arm 67 carried on the upper end of the lift cylinder piston rod is engageable with one or more of the wood members of the completed truss for lifting it clear of the supports 11 and stops 39. Arm 65 carries a series of rollers 69 engageable with various wood members of the completed truss enabling the truss to be rolled from apparatus after it has been lifted clear of the supports. Lift units 59 also include a swing cylinder unit (not shown) interconnected between the mounting bracket 61 and lift cylinder 63 for effecting swinging of the lift cylinder between its stowed and lifting positions. This truss ejector system is described in detail in my above-mentioned U.S. Pat. No. 3,866,530.

As is shown in FIG. 4, horizontal member 27 has a pair of guide channels 73 secured to its bottom, these channels extending between posts 25. Each mounting bracket 61 has a plurality of clamping lugs 75 at its upper end which are received by the guide channels. Thus, each lifting unit 59 is movable along the horizontal member to any desired position at which its arm 63 may most advantageously engage the wood members for enabling rolling of the truss. Operation of lifting means 57 is effected automatically upon the completion of the truss after the presses 3*a*, 3*b* have moved clear of the truss and after clamping cylinders 45 have been released. Means (not shown) are provided in the air supply system for the lift units which prevents movement of the lift cylinder 61 of each lift unit from its lowered retracted position to its raised lifting position until after its swing cylinder 67 has swung the lift cylinder from its stowed to its lifting position.

Presses 3*a* and 3*b* and press carriages or carts 15*a*, 15*b* are essentially identical and for that reason only one press 3*b* and its respective press carriage 15*b* need be described in detail. As is shown in FIG. 4, each track means 17*a*, 17*b* for the press carriages includes an inverted V-shaped rail 77 adjacent frames 23 and a flat outer rail 79, these rails extending the length of apparatus 1 from one frame 23 to the other. Press carriage 15*b* comprises a base 81 mounted on a pair of grooved rollers 83 rolling on the inverted V-rail for guiding the carriage along the track, and on a pair of rubber-tire drive wheels 85 engageable with the flat rail 79 for driving the carriage along the track. Drive wheels 85 are driven by a reversible hydraulic motor 87, this motor also constituting means for decelerating and stopping the carriage. Base 81 has an electrically driven hydraulic pressure unit generally indicated at 89 mounted thereon including an electric motor M-1, a hydraulic pump and a hydraulic fluid reservoir (see FIG. 5). This hydraulic unit supplies hydraulic fluid under pressure to motor 87 for driving the carriage along the track and for operating press 3*b*. Power for the electric motor is supplied by means of a respective bus 95 carried by the frames 23.

Figure 5:
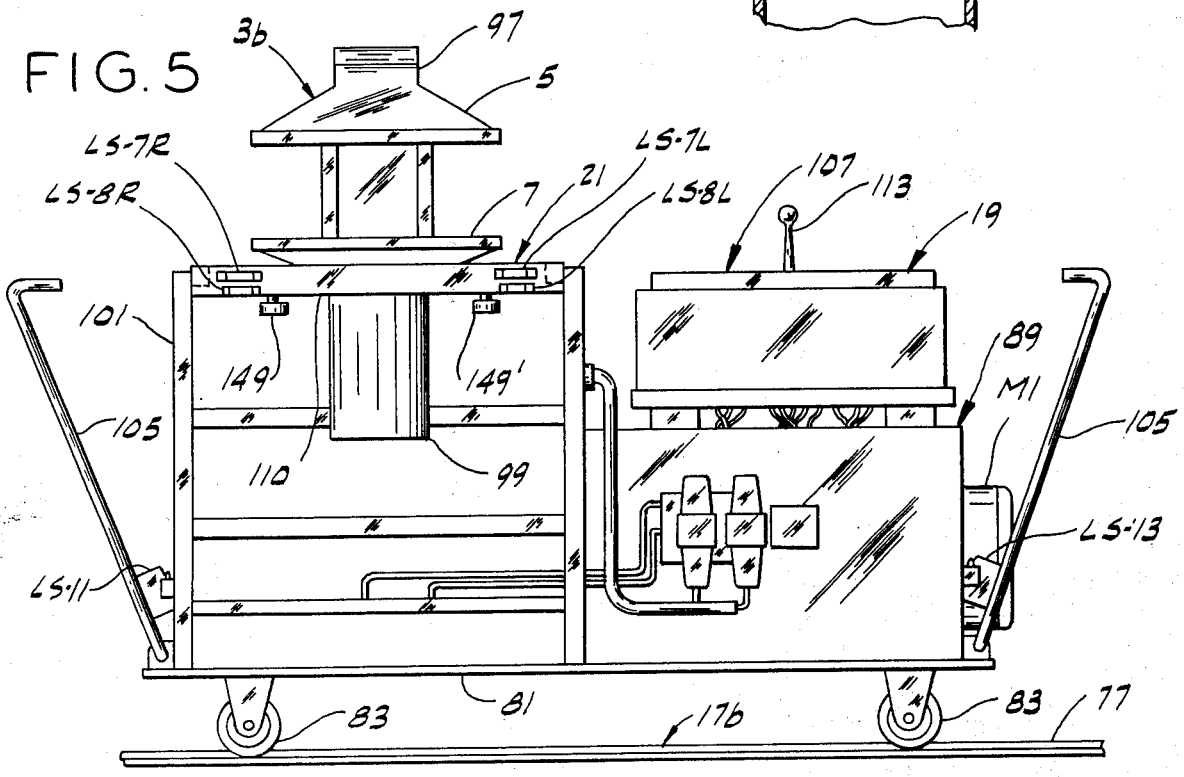
FIG. 5 is a front elevational view of a press cart.

As shown in FIGS. 4 and 5, press 3*b* includes a C-shaped press frame 97 and a fluid power cylinder 99 operable for effecting movement of the upper platen 5 and the lower platen 7 toward and away from one another. The press also includes means (not shown) for preventing the platens of the press from exerting unequal forces on the arms 13 as the nailing plates N are driven into the wood members, so as to prevent damage to the arms. This last-said means may be of the type shown in U.S. Pat. No. 3,728,958 or other similar means known in the art. The press carriage has a pair of spaced supports 101 extending up from base 81 for mounting the press in position for driving nailing plates into the wood members. The press is mounted on rollers 103 on either side of the press frame received in respective tracks 104 secured to the upper, inner portions of supports 101 in a manner similar to the way in which the presses in my above-mentioned U.S. Pat. No. 3,866,530 are mounted in their respective stands, thus enabling the press to be moved in and out relative to frame 23 and thus allowing the top platen 5 to be moved clear of its respective truss chord. Also, rollers 103 permit the press to be moved in and out to fabricate trusses of various depths. At each end of the carriage, a pivoted safety bar 105 is provided for actuating a respective safety switch LS-11 or LS-13. Upon movement of either safety bar from the position shown in FIG. 5, as may be occasioned by the safety bar striking a person on tracks 17*a*, 17*b* as the carriage moves therealong, the carriage is brought to an intermediate halt.

The previously mentioned sensing means 21 for each carriage 15*a*, 15*b* further includes means 107 for selectively effecting operation of the sensing means so as to sense the approach of its respective press 3*a*, 3*b* to its operating position at each support 11 from one direction or the other along a chord of the truss being fabricated. Again, carriage 15*b* and press 3*b* will be referred to in describing means 21 and 107, but it will be understood that the means 21 and 107 of carriage 15*a* and press 3*a* are essentially identical. Briefly, this sensing means comprises two pairs of switches LS-7L and LS-8R, LS-7R and LS-8L (see FIG. 5) carried by and movable in and out relative to frame 23 with the press. Switches LS-7L and LS-8R are operable as the press 3*b* moves from right to left (as viewed in FIG. 5) and switches LS-7R and LS-8L are operable as the press moves from left to right. One switch of each pair is actuated by means, as indicated at 109 to FIGS. 2, 3, 3A, and 4, carried generally by frame 23 and carried specifically by each support 11 as the press approaches its operating position at a support for initiating deceleration of the press carriage 15*b* and the other of the switches is actuable by the actuating means 109 for stopping movement of the press carriage along the track 17*b* with the press in its operating position at one of the supports 11. With both of the switches actuated, circuits are energized to initiate closing of the press to drive nailing plates N into the wood members. As shown in FIG. 5, switches LS-7L, LS-7R, LS-8L, LS-8R are carried on a horizontal bar 110 secured to press frame 97. Preferably, switches LS-7L, LS-8R, LS-7R and LS-8L are magnetic proximity switches of the type actuable in response to a magnetic field of a predetermined strength, and the actuating means 109 comprises a pair of magnets 111*a*, 111*b* (see FIGS. 3, 3A) secured to plate 31 at each of the supports. As is shown in FIG. 4, magnets 111*a*, 111*b* and the magnetic switches are positioned on the support and on the press carriage so that the switches pass in close proximity to the magnets as the press carriage moves along the track thereby to actuate the switches as they pass by the magnets. As is shown in FIG. 5, the switches of each pair are spaced apart a predetermined distance (about 18 – 20 inches) and the magnets 111*a*, 111*b* on each of the supports are spaced a corresponding distance so that, when the press is in its operating position, both switches of each pair are actuated by the magnets. Although magnetic switches are shown, it will be understood that mechanically operated limit switches or other proximity sensing means may also be used. For example, sensing or switch means 21 may be radio field proximity switches carried by the press and actuating means 109 may be metal targets carried by the supports to be within a desired proximity of the radio proximity switches when the press is in its desired operating position.

As heretofore mentioned, a power-operated end clamp or stop 55 (see FIGS. 1 and 2) is provided at each end of the truss being fabricated to prevent endwise movement of the outermost web member relative to the chord members UC and LC beyond a desired position and to prevent the ends of the chord members from moving apart beyond a desired distance (i.e., the ends of the chord members are held substantially parallel to one another). More particularly, end clamp 55 is shown to comprise a base 113 supported on clamping channels 29 and movable longitudinally therealong. Base 113 is releasably secured to the clamping channel at any selected position therealong by clamping bolts 115. The base extends up from the clamping channels to a height generally corresponding to the height of the upper surfaces of cantilever arms 13. The closed end of an air cylinder 117 is secured to the upper end of the base with the piston rod 119 of the air cylinder directed away from the end of the truss being fabricated. The base has a pair of spaced guides 121*a*, 121*b* each having a respective guide opening of generally square cross section. These openings each receive a respective slide arm 125*a*, 125*b* therewithin for sliding relative to the guides in generally horizontal direction toward and away from the adjacent ends of truss T being fabricated. The free end of piston rod 119 is secured to a yoke 127 which in turn is secured to slide arms 125*a*, 125*b* so that upon actuation of air cylinder 117 the slide arms are caused to reciprocte toward and away from the end of the truss. At the ends of arms 125*a*, 125*b* adjacent truss T, a clamping bracket 129 is secured thereto. This bracket is channel shaped and carries a pair of corner clamps 131*a*, 131*b*. These corner clamps are adjustably movable along the bracket heightwise of the truss. Each corner clamp is releasably securable to the bracket in any adjusted position therealong by means of clamping bolts (not shown). Each corner clamp 131*a*, 131*b* has a respective base portion 133*a*, 133*b* generally parallel to the bracket engageable with the outer ends of the upper and lower chord members UC and LC and with the outer face of the outermost web member W, and a respective flange portion 135*a*, 135*b* at the outer ends of its base portion. The ends of these flanges flare outwardly and their inner faces are disposed to engage the outer faces of the chord members LC and UC. Thus, upon actuation of air cylinder 117 to extend arms 125*a*, 125*b* toward the end of truss T, clamping bracket 129 with corner clamps secured thereto in adjusted position is moved to its operating or clamping position in which it serves as a stop for the end web member to prevent endwise movement of the end web member beyond the ends of the upper and lower chords and for holding the ends of the chord members at a selected spacing relative to one another. It will be noted that flange portions 135*a*, 135*b* may have a certain amount of draft to cammingly force the ends of the chords into tight abutting relation with the ends of the outer web member. Upon actuation of air cylinder 117 in opposite direction, clamping bracket 129 is moved in endwise direction away from the ends of the truss, thereby to facilitate lifting of the truss vertically by ejector units 59 without binding of the truss on the clamping bracket. Also, with clamping brackets 129 movable endwise to their respepctive retracted position, the ends of the truss are unrestrained and thus permit the length of the truss to increase without binding in the event the truss ejectors 59 at the center of the truss are actuated before the end ejectors. It will be noted that slide arms 125*a*, 125*b* may be provided with a series of equally spaced holes 139 therein for reception of locating pins 141 which secure yoke 127 to the arms, thereby to prevent ready adjustment of the adjustment yoke relative to the slide arms so as to accommodate trusses of various lengths and also to accommodate various locations of end support 11. It will be appreciated that clamping brackets 129 are of a height somewhat less than the thickness of a wood member so that the platens 5 and 7 of the presses 3*a* and 3*b* may close on the ends of the truss to drive nailing plates N into the ends of the chord and web members without damage to the end lumber clamp. Also by providing for adjustment of slide arms 125*a*, 125*b* relative to air cylinder 117, the slide arms may be adjusted to reach over an end support 11. It will be understood that air cylinder 117 may be automatically operated in accordance with a desired operating sequence in coordination with operation of other various components of the apparatus to insure that the end clamps are moved clear of the ends of the truss prior to ejector cylinders 59 being automatically actuated for ejection of the truss.

As previously mentioned, press frame 97 of each press 3*a*, 3*b* is mounted on rollers 103 received in tracks 104 to permit the press frame to be moved in and out relative to frame 23 (see FIGS. 4 and 5). In accordance with this invention, means generally indicated at 142 is provided for maintaining sensing means 21 (i.e., switches LS-7R, LS-8R, LS-7L, LS-8L) carried by the press and the actuating means 109 (i.e., magnets 111*a*, 111*b*) carried by the supports in predetermined in-and-out relation relative to one another as the press moves laterally along frame 23 to insure actuation of the switches as the press moves laterally from one station to the next. More particularly, this last-mentioned means comprises a spring 143 at each side of press frame 97 which biases the latter inwardly toward frame 23. This spring is a tension spring stretched between a bracket 145 secured to the press frame between rollers 103 and a pin 147 secured to a respective track 104. These springs bias the press head inwardly. A pair of rollers 149, 149′ is carried by the press frame, one roller on each side of the press, for rotation about respective generally verticcal axes. Clamping channels 29 have vertical outwardly facing edges 151*a* 151*b* which constitute continuous guide rails extending longitudinally of frame 23. Springs 143 bias the press head inwardly toward the frame and hold rollers 149, 149′ in rolling engagement with respective guide rail surfaces 151*a*, 151*b* thereby to prevent inward movement of the press toward the frame beyond a predetermined position. Thus, springs 143 and rollers 149, 140′ insure that the switches carried by the press and the magnets on the support are maintained in desired spaced relation as the press moves laterally and thus insure operation of the press at each operating position.

Operation of the improved truss fabricating apparatus of this invention is essentially the same as the operation of the apparatus described in my abovementioned U.S. Pat. No. 3,866,530 and therefore is not herein described.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for fabricating wood structures, such as trusses of the type having lower chord members, upper chord members and web members extending from the lower chord members to the upper chord members, said apparatus comprising a press having an upper and a lower platen which are relatively movable toward and away from one another for driving nailing plates into two or more of the wood members of the truss from above and below, means for supporting the wood members which are to be joined together by said nailing plates, said supporting means including a plurality of supports and means cantilevered relative to each support for holding wood members with clearance therebelow for said press, and means mounting said press for movement thereof along a chord into an operating position at a first support for driving nailing plates into the wood members, and for movement in a generally lateral direction with respect to the press sideways out of its operating position at the first support and into its operating position at the next successive support along said chord, said supporting means further comprising a frame having an upwardly facing horizontal surface carrying a series of said supports for holding said upper chord members and a second series of said supports for holding said lower chord members, said first and second series of supports having cantilever means secured thereto, said supports for the upper chord members and said supports for the lower chord members being arranged in close back-to-back relation substantially at the vertical longitudinal center plane of said frame and being movable relative to one another longitudinally along said frame, each said support having a generally horizontal base and a generally vertical member extending up from the inner edge of the base adjacent said vertical longitudinal center plane of the frame, said base having a bottom surface for engagement with said horizontal surface of said frame and said vertical member having an inner, generally vertical face adapted to engage a corresponding inner face of another support in back-to-back relation therewith, the included angle between said bottom surface and said inner surface ranging between about 90.5° and 95°, and means for releasably securing said support to said horizontal surface on said frame which when unsecured permits said support to be moved longitudinally along said frame to any selected position therealong and which when secured fixedly secures said support to said horizontal surface, whereby with two of said supports at least partially in back-to-back relation on said frame and with said two supports being fixedly secured to said horizontal surface with their bottom surfaces substantially flush with said horizontal surface, their said vertical member inner surfaces are drawn together in face-to-face engagement substantially on said longitudinal vertical center plane of said frame and are preloaded to resist outward movement of said vertical members away from said vertical center plane.

2. Apparatus as set forth in claim 1 wherein said vertical member comprises a plate, and wherein said base is welded to said plate at substantially a right angle, said bottom surface of said base being machined to establish said included angle between said bottom surface and said inner surface of said plate.

3. Apparatus as set forth in claim 2 wherein said frame has a clamping channel extending longitudinally therealong, the top surface of said clamping channel constituting said horizontal surface, and wherein said means for releasably securing each of said supports to said horizontal surface comprises clamping means carried by said base member engageable with said clamping channel for selectively fixedly securing said support to said frame at any selected position therealong.

4. Apparatus as set forth in claim 1 wherein said included angle ranges between about 91° and 92°.

5. Apparatus for fabricating wood structures, such as trusses of the type having lower chord members, upper chord members and web members extending from the lower chord members to the upper chord members, said apparatus comprising two presses each having an upper and a lower platen which are relatively movable toward and away from one another for driving nailing plates into two or more of the wood members of the truss from above and below, means for supporting the wood members which are to be joined together by said nailing plates, said supporting means including a plurality of supports and means cantilivered relative to each support for holding wood members with clearance therebelow, means mounting one press adjacent the upper chord and means mounting the other press adjacent the lower chord for movement of each press along its respective chord into an operating position at a first support for driving nailing plates into the wood members, and for movement in a generally lateral direction with respect to the press sideways out of its operating position at said first support and into its operating position at a next successive support along its respective chord, means for biasing said web members into abutting relation with said upper chord members and with said lower chord members so that said upper chord and said lower chord members are forced outwardly away from one another, said cantilever means including means for holding said chord members in selected spaced relation relative to one another, said support means comprising a frame having an upwardly facing horizontal surface carrying a first series of supports on one side of the longitudinal vertical center plane of the frame for holding said upper chord members and a second series of supports on the other side of said center plane for holding said lower chord members, said first and second series of supports also supporting said web members in position to be secured to said upper and lower chord members by nailing plates so as to form a truss, said supports for the upper chord members and said supports for the lower chord members being arranged in close back-to-back relation and being movable relative to one another longitudinally along said frame, each said support having a generally horizontal base and a generally vertical plate secured to the inner edge of said base, said base having a bottom surface adaped to engage said horizontal surface of said frame, said vertical member having an inner, generally vertical face adapted to engage a corresponding inner face of another support in back-to-back relation therewith, and an included angle between said bottom surface of said base and said inner surface of said vertical plate varying between about 90.5° and 95°, said base and said vertical plate having said included angle therebetween constituting means for resisting the outward forces on said cantilever members, said apparatus further comprising means for releasably securing the base of each of said supports to said horizontal surface of said frame which when unsecured permits said support to be moved longitudinally along the frame to a selected position and which when secured fixedly secures said support to said horizontal surface of said frame, whereby with two of said supports at least partially in back-to-back relation on said frame and with said two supports being fixedly secured to said track with the bottom surfaces of the bases being substantially flush with said horizontal frame surface, there respective vertical plates are drawn together into face-to-face engagement so as to preload these plates to resist said outward forces.

6. Apparatus for fabricating wood structures, such as a truss having upper and lower chord members spaced from one another and a plurality of web members extending between the chord members, said apparatus comprising means for supporting said wood members in position for having nailing plates driven thereinto from above and below at the intersections of the wood members to form said truss, said supporting means comprising a frame extending longitudinally of the truss and a plurality of supports movable longitudinally with the frame for supporting the wood members at each of said intersections, said apparatus further comprising means for driving said nailing plates into said wood members, means for holding said wood members on said supports in a desired position for being secured together by said nailing plates, and means movable between an operating position for holding at least one end of said upper and lower chord members in desired spaced relation and for holding an end web member in a selected position relative to said one ends of said chord members during fabrication of the truss and a retracted position to facilitate lifting of said truss generally vertically for removal of the truss from the apparatus.

7. Apparatus as set forth in claim 6 wherein said upper and lower chord members are substantially parallel to one another, and wherein said outer web member is substantially perpendicular to the chord members at said one ends thereof with intermediate web members in abutting relation with the inner faces of said upper and lower chord members and with an adjacent web member, said apparatus further comprising means for biasing said web members toward the ends of the truss into abutting relation with said chord members and with one another prior to being secured together by said nailing plates, said movable holding means being engageable with said one end web member when said holding means is in its operating position thereby to prevent movement of said one end web member out beyond the ends of said chord members.

8. Apparatus as set forth in claim 7 wherein said movable holding means further comprises power-operated means for moving said holding means between its operating and retracted positions.

9. Apparatus as set forth in claim 8 wherein said power-operated means comprises an air cylinder unit.

10. Apparatus as set forth in claim 9 wherein said movable holding means further comprises a bracket carried by said air cylinder unit for movement in horizontal direction toward and away from said one end of said truss for engagement with the outer face of said end web member to prevent endwise movement of said end web member out beyond said one ends of said chord members and with the outer faces of said upper and lower chord members to prevent outward movement of the ends of said chord members away from one another.

11. Apparatus as set forth in claim 8 wherein said movable holding means further comprises means for adjustably mounting said movable holding means on said frame so as to accommodate trusses of varying lengths.

12. Apparatus for fabricating wood structures, such as trusses of the type having lower chord members, upper chord members and web members extending from the lower chord members to the upper chord members, said apparatus comprising a press having an upper platen and a lower platen which are relatively movable toward and away from one another for driving nailing plates into two or more of the wood members of the truss from above and below, means for supporting the wood members which are to be joined together by said nailing plates, said supporting means including a frame and means cantilevered relative to said frame for holding wood members with clearance therebelow, means mounting said press adjacent one of said chords for movement of the press along said one chord to an operating position at a first station for driving nailing plates into the wood members and for movement in a generally lateral direction with respect to the press sideways out of its operating position at said first station and into an operating position at a next successive station along said one chord, and means for controlling movement of said press mounting means including actuating means at each station and switch means carried along with the press, said switch means being actuable by said actuating means as the press moves into its operating position at a station for stopping movement for the press mounting means with the press in its operating position at the station, said press being movable relative to said press mounting means toward and away from said frame and carrying said switch means for actuation by said actuating means, said apparatus further comprising means for maintaining said switch means carried by the press and said actuating means carried by the frame in predetermined in-and-out relation relative to one another as said press moves laterally from one station to the next, the maintenance means comprising means for biasing said press inwardly toward said frame, guide means carried by the frame, and means carried by said press and movable therewith engageable with said guide means for limiting inward movement of the press toward the frame.

13. Apparatus as set forth in claim 12 wherein said guide means comprising a continuous rail extending longitudinally of said frame and wherein said means for limiting inward movement of the press comprises a pair of rollers, one on each side of the press, engageable with said guide rail.

14. Apparatus as set forth in claim 12 wherein said switch means comprises a first proximity switch carried by the press actuable by said actuating means as the press approaches its operating position at a station for initiating deceleration of the press mounting means and a second proximity switch carried by the press actuable by said actuating means for stopping the press mounting means when the press is in its operating position at the last mentioned station.

15. Apparatus as set forth in claim 12 wherein said biasing means comprises a spring interposed between said press and said press mounting means for biasing said press inwardly toward the frame.

* * * * *